US006072452A

United States Patent [19]

Worley, III et al.

[11] Patent Number: 6,072,452

[45] Date of Patent: Jun. 6, 2000

[54] SYSTEM AND METHOD FOR USING FORCED STATES TO IMPROVE GRAY SCALE PERFORMANCE OF A DISPLAY

[75] Inventors: W. Spencer Worley, III, Half Moon Bay; Raymond Pinkham, Los Gatos, both of Calif.

[73] Assignee: Aurora Systems, Inc., San Jose, Calif.

[21] Appl. No.: 08/970,878

[22] Filed: Nov. 14, 1997

[51] Int. Cl.[7] ..... G09G 3/36

[52] U.S. Cl. ..... 345/89; 345/153; 345/147

[58] Field of Search ..... 345/87, 147, 148, 345/96, 98, 100, 89, 90, 203, 153, 155, 149; 348/714, 715, 716, 671, 771

[56] References Cited

U.S. PATENT DOCUMENTS

| | | | |
|---|---|---|---|
| 4,626,835 | 12/1986 | Nienaber et al. | 340/703 |
| 5,278,652 | 1/1994 | Urbanus et al. | 358/160 |
| 5,339,116 | 8/1994 | Urbanus et al. | 348/716 |
| 5,469,190 | 11/1995 | Masterson | 345/155 |
| 5,523,803 | 6/1996 | Urbanus et al. | 348/771 |
| 5,596,349 | 1/1997 | Kobayashi et al. | 345/147 |
| 5,712,657 | 1/1998 | Eglit et al. | 345/147 |
| 5,798,740 | 8/1998 | Bitzakidis et al. | 345/92 |

*Primary Examiner*—Lun-Yi Lao
*Assistant Examiner*—Jimmy Hai Nguyen
*Attorney, Agent, or Firm*—Henneman & Saunders; Larry E. Henneman, Jr.

[57] ABSTRACT

A display driver circuit and method for receiving a display data stream, modifying the display data stream to enhance gray scale performance, and outputting the modified display data stream. The display driver includes a forced state generator for adding at least one forced state to the display data stream to create the modified display data stream. The forced state generator includes a multiplexer and a forced state controller. The multiplexer includes a data input terminal for receiving the display data stream, a first forced state input terminal for receiving first forced state data, a second forced state input terminal for receiving second forced state data, a data output terminal for outputting the modified display data stream, and a pair of control input terminals. The forced state controller includes a pair of control output terminals coupled the control input terminals of the multiplexer. Responsive to signals asserted on the control input terminals, the multiplexer selectively couples its data input terminal, its first forced state input terminal, and its second forced state input terminal with its data output terminal, thus generating the modified display data stream.

47 Claims, 10 Drawing Sheets

SYSTEM AND METHOD FOR USING FORCED STATES TO IMPROVE GRAY SCALE PERFORMANCE OF A DISPLAY

CROSS-REFERENCE TO MICROFICHE APPENDIX

The microfiche appendix, which is a part of the present disclosure, contains one (1) sheet of microfiche having fifteen (15) frames, and provides verilog code for implementing a particular embodiment of the present invention. A portion of the disclosure of this patent document contains material which is subject to copyright protection. The copyright owner has no objection to the facsimile reproduction by anyone of the patent document or the patent disclosure, as it appears on the Patent and Trademark Office patent files or records, but otherwise reserves all copyright rights.

BACKGROUND OF THE INVENTION

1. Field of the Invention

This invention relates generally to electronic display drivers, and more particularly to a driver for a liquid crystal display capable of achieving improved gray scale performance through the use of forced states.

2. Description of the Background Art

FIG. 1 shows a single pixel cell 100 of a typical liquid crystal display. Pixel cell 100 includes a liquid crystal layer 102, contained between a transparent common electrode 104 and pixel storage electrode 106, a storage element 108, and a switching transistor 110. Storage element 108 is coupled at node 112 to pixel storage electrode 106 and, via switching transistor 110, to a data input line 114. Storage element 108 is also coupled, as is common electrode 104 to a common voltage supply terminal 116 (e.g., ground). Responsive to a select signal on select line 118, which is coupled to the control terminal of switching transistor 110, storage element 108 reads a data signal in from data line 114, stores the signal, and asserts the signal on node 112, even after the select signal is no longer present.

Liquid crystal layer 102 rotates the polarization of light passing through it, the degree of rotation depending on the root-mean-square (RMS) voltage across liquid crystal layer 102. The ability to rotate the polarization is exploited to modulate the intensity of reflected light as follows. An incident light beam 120 is polarized by polarizer 122. The polarized beam then passes through liquid crystal layer 102, is reflected off of pixel electrode 106, and passes again through liquid crystal layer 102. During this double pass through liquid crystal layer 102, the beam's polarization is rotated by an amount which depends on the data signal being asserted on pixel storage electrode 106. The beam then passes through polarizer 124, which passes only that portion of the beam having a specified polarity. Thus, the intensity of the reflected beam passing through polarizer 124 depends on the amount of polarization rotation induced in liquid crystal layer 102, which in turn depends on the data signal being asserted on pixel storage electrode 106.

Storage element 108 can be either an analog storage element (e.g. capacitative) or a digital storage element (e.g., SRAM latch). In the case of a digital storage element, a common way to drive pixel storage electrode 106 is via pulse-width-modulation (PWM). In PWM, different gray scale levels are represented by multi-bit words (i.e., binary numbers). The multi-bit words are converted to a series of pulses, whose time-averaged root-mean-square (RMS) voltage corresponds to the analog voltage necessary to attain the desired gray scale value.

For example, in a 4-bit PWM scheme, the frame time (time in which a gray scale value is written to every pixel) is divided into 15 time intervals. During each interval, a signal (high, e.g., 5V or low, e.g., 0V) is asserted on the pixel storage electrode 106. There are, therefore, 16 (0–15) different gray scale values possible, depending on the number of "high" pulses asserted during the frame time. The assertion of 0 high pulses corresponds to a gray scale value of 0 (RMS 0V), whereas the assertion of 15 high pulses corresponds to a gray scale value of 16 (RMS 5V). Intermediate numbers of high pulses correspond to intermediate gray scale levels.

A particular signal being applied during a time interval is referred to as a "state". For example, a high signal being asserted during one time interval is an "on" state. Similarly, a low signal being asserted during one time interval is referred to as an "off" state.

FIG. 2 shows a series of pulses corresponding to the 4-bit gray scale value (1010), where the most significant bit is the far left bit. The pulses are grouped to correspond to the bits of the binary gray scale value. Specifically, the first group B3 includes 8 intervals ($2^3$), and corresponds to the most significant bit of the value (1010). Similarly, group B2 includes 4 intervals ($2^2$) corresponding to the next most significant bit, group B1 includes 2 intervals ($2^1$) corresponding to the next most significant bit, and group B0 includes 1 interval ($2^0$) corresponding to the least significant bit. This grouping reduces the number of pulses required from 15 to 4, one for each bit of the binary gray scale value, with the width of each pulse corresponding to the significance of its associated bit. Thus, for the value (1010), the first pulse B3 (8 intervals wide) is high, the second pulse B2 (4 intervals wide) is low), the third pulse B1 (2 intervals wide) is high, and the last pulse B0 (1 interval wide) is low. This series of pulses results in an RMS voltage that is approximately $$\sqrt{\frac{2}{3}}$$

(10 of 15 intervals) of the full value (5V), or approximately 4.1 V.

The resolution of the gray scale can be improved by adding additional bits to the binary gray scale value. For example, if 8 bits are used, the frame time is divided into 255 intervals, providing 256 possible gray scale values. In general, for (n) bits, the frame time is divided into ($2^n$−1) intervals, yielding ($2^n$) possible gray scale values.

Because the liquid crystal cells are susceptible to deterioration due to ionic migration resulting from a DC voltage being applied across them, the above described PWM scheme is modified as shown in FIG. 3. The frame time is divided in half. During the first half, the PWM data is asserted on the pixel storage electrode, while the common electrode is held low. During the second half of the frame time, the complement of the PWM data is asserted on the pixel storage electrode, while the common electrode is held high. This results in a net DC component of 0V, avoiding deterioration of the liquid crystal cell, without changing the RMS voltage across the cell, as is well known to those skilled in the art.

FIG. 4 shows a response curve of an electrically controlled, birefringent liquid crystal cell. The vertical axis 402 indicates the percent of full brightness (i.e., maximum light reflection) of the cell, and the horizontal axis 404 indicates the RMS voltage across the cell. As shown, the minimum brightness (a dark pixel) is achieved at an RMS voltage Vtt. For some wavelengths of light, an RMS voltage less than Vtt results in a pixel that is not completely dark, as shown in FIG. 4. For other wavelengths, all RMS voltages less than Vtt result in a dark pixel. In the portion of the curve between Vtt and Vsat, the percent brightness increases as the RMS voltage increases, until 100% full brightness is reached at Vsat. Once the RMS voltage exceeds Vsat, however, the percent brightness decreases as the RMS voltage increases.

FIG. 5 shows an RMS voltage versus gray scale value curve, for an 8-bit (256 gray scale values) gray scale system. The RMS voltage for each gray scale value ("Gray Value") is given by the following formula, where Von is the digital "on" value, typically Vdd:

$$Vrms = \sqrt{(1/255)(GrayValue)(Von)^2} \quad \text{(Eq. 1)}$$

Gray scale value (x) corresponds to an RMS voltage equal to Vtt and, referring back to FIG. 4, to 0% brightness. Thus, the gray scale values less than value (x) are unusable, because for some wavelengths of light, they result in a brighter rather than a darker pixel, and for other wavelengths, the values result in 0% brightness and are, therefore, redundant. Similarly, value (y) corresponds to an RMS voltage equal to Vsat and, referring back to FIG. 4, to 100% full brightness. Thus, the gray scale values greater than value (y) are also unusable, because they result in a darker rather than a brighter pixel. The result of these wasted values is that true 8-bit gray scale resolution is not obtained.

In order to avoid gray scale distortions, all gray scale values must be confined to the useful portion of the liquid crystal response curve (FIG. 4) between Vtt and Vsat. One way to accomplish this is to add an additional bit to the gray scale code (e.g., use a 9-bit gray scale system) and then map the 8-bit values to the values of the 9-bit system corresponding to the useful portion of the response curve. The addition of a single bit, however, increases the bandwidth requirements of the data interface by 100%, and is, therefore, undesirable. What is needed is a system and method for confining all of the available gray scale states to the useful portion of the liquid crystal response curve.

SUMMARY

A novel display driver circuit is described. The display driver receives a display data stream, modifies the display data stream, and provides a modified display data stream having improved gray scale attributes. The display driver includes a state generator, which receives the data stream, and modifies the data stream by adding at least one forced state to generate the modified data stream.

In one embodiment, the state generator includes a multiplexer and a controller. The multiplexer has a data input terminal for receiving the display data stream, a first forced state input terminal for receiving first forced state data, a data output terminal, and a control input terminal. The controller has a control output terminal that is coupled to the control input terminal of the multiplexer, for causing the multiplexer to selectively couple its data input terminal and its first forced state input terminal with its data output terminal to provide the modified display data stream on its data output terminal. Optionally, the display driver includes a source of the first forced state data, for example a system voltage reference terminal, coupled to the first forced state input terminal of the multiplexer.

In a specific embodiment, the multiplexer further includes a second forced state input terminal for receiving second forced state data, and a second control input terminal. The controller further includes a second control output terminal, which is coupled to the second control input terminal of the multiplexer. Responsive to a control signal being asserted on its first and second control input terminals, the multiplexer selectively couples its first forced state input terminal, its second forced state input terminal, and its data input terminal to its data output terminal. Optionally, the display driver includes a source of the second forced state data, for example a system voltage reference terminal, coupled to the second forced state input terminal of the multiplexer.

In yet another embodiment, the forced state controller includes an invert terminal for outputting an invert control signal. Optionally, this embodiment includes a selective inverter, with a control input terminal coupled to the invert terminal of the controller. In one embodiment, the selective inverter has an input terminal coupled to receive the display data stream, and an output terminal coupled to the data input terminal of the multiplexer. Responsive to an invert signal on its control terminal, the selective inverter inverts the display data stream. Alternatively, the input terminal of the selective inverter is coupled to the data output terminal of the multiplexer, and, responsive to an invert signal on its control terminal, the selective inverter inverts the modified display data stream.

A novel method for modifying a display data stream to achieve improved gray scale performance is also described. The method includes the steps of receiving a display data stream, adding at least one forced state of a first type to the display data stream to create a modified display data stream, and outputting the modified display data stream. A particular method further includes the step of adding at least one forced state of a second type. Optionally, the step of adding at least one forced state of the first type includes adding a plurality of forced states of the first type, and the step of adding at least one forced state of the second type includes adding a plurality of forced states of the second type. In one method, the forced states of the first type are digital "on" states, and the forced states of the second type are digital "off" states. Further, the forced states of both the first and second type may be added contiguously.

In another particular method, the step of outputting the modified display data stream includes the steps of outputting the plurality of forced states of the first type, outputting the display data stream, and outputting the plurality of forced states of the second type. Optionally, this method further includes the steps of outputting the complement of the plurality of forced states of the first type, outputting the complement of the display data stream, and outputting the complement of the plurality of forced states of the second type. Alternatively, this particular method further includes the steps of outputting an invert signal, outputting the plurality of forced states of the first type a second time, outputting the display data stream a second time, and outputting the plurality of forced states of the second type a second time.

A program storage device readable by a machine and encoding a program of instructions for executing the above described methods is also described.

DETAILED DESCRIPTION

This patent application is related to the following co-pending patent applications, filed on even date herewith and assigned to a common assignee, each of which is incorporated herein by reference in its entirety:

De-Centered Lens Group For Use In An Off-Axis Projector, Serial No. M-5011, Matthew F. Bone and Donald Griffin. Koch;

System And Method For Reducing Peak Current And Bandwidth Requirements In A Display Driver Circuit, Serial No. M-5016, Raymond Pinkham, W. Spencer Worley, III, Edwin Lyle Hudson, and John Gray Campbell;

System And Method For Data Planarization, Serial No. M-5246, William Weatherford, W. Spencer Worley, III, and Wing Chow; and Internal Row Sequencer For Reducing Bandwidth And Peak Current Requirements In A Display Driver Circuit, Serial No. M-5281, Raymond Pinkham, W. Spencer Worley, III, Edwin Lyle Hudson, and John Gray Campbell.

This patent application is also related to co-pending patent application serial no. M-5019, entitled Replacing Defective Circuit Elements By Column And Row Shifting In A Flat Panel Display, by Raymond Pinkham, filed Jul. 25, 1997, assigned to a common assignee, and is incorporated herein by reference in its entirety.

The present invention overcomes the problems associated with the prior art, by confining the gray scale values to the useful portion of the liquid crystal response curve, without the use of additional data bits. Specifically, the present invention describes a system and method for aligning an RMS response generated from multi-bit gray scale codes with the useful portion of a display response curve. In the following description, numerous specific details are set forth (e.g., the bit-width of the gray scale code and the specific operating voltages) in order to provide a thorough understanding of the invention. Those skilled in the art will recognize, however, that the invention may be practiced apart from these specific details. In other instances, details of well known display circuits and driving methods have been omitted, so as not to unnecessarily obscure the present invention.

Figure 6:
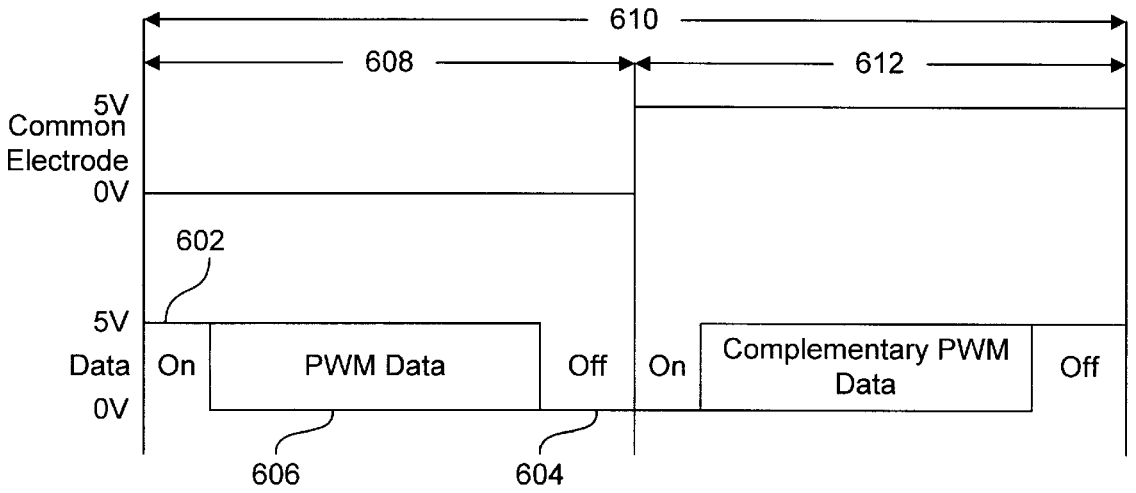
FIG. 6 shows a split frame of pulse-width modulation data including additional forced on and forced off states, in accordance with the present invention.

As shown in FIG. 6, additional forced "on" states 602 and additional forced "off" states 604 are added to the PWM data 606 during the first half 608 of the frame time 610, to produce a modified display data stream. The extra "on" states 602 and "off" states 604 correspond to extra time intervals in frame time 610, which are added in one of two different ways. In the first way, the time intervals of the PWM data 606 are shortened to make room for the additional states, without increasing the frame time. Alternatively, the frame time may be increased to make room for the new states, without changing the length of the individual time intervals of the PWM data.

During the first half of the frame time, the common electrode of a driven liquid crystal cell (not shown) is held low (0V). In the second half 612 of frame time 610, however, the common electrode is held at 5V, and the PWM data as well as the added "on" and "off" states are inverted. This inversion is necessary to maintain a net DC voltage of 0 V across the driven cell, and thus avoid degradation of the cell.

Note that in FIG. 6, the forced on states 602 and forced off states 604 are added to the display data 606 contiguously (i.e., sequentially in a single block of time intervals). This advantageously reduces the number of times the signal to the display must be switched. Those skilled in the art will recognize, however, that the forced states may be intermingled amongst themselves, or with the display data,. as long as the resultant RMS voltage is not altered.

Figure 7:
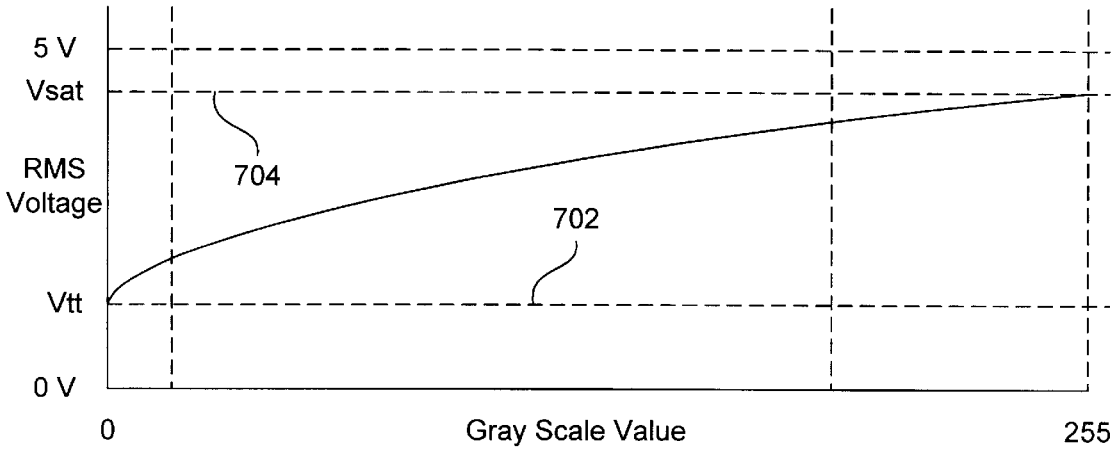
FIG. 7 shows a gray scale value versus RMS voltage curve, as modified by the addition of forced on and forced off states in accordance with the present invention.

FIG. 7 shows the effect of the added forced states on the gray scale value versus RMS voltage curve. Taking the added forced states into account, the modified RMS value is given by:

$$Vrms = \sqrt{\frac{(ForcedOn + GrayValue)(Von)^2}{(255 + ForcedOn + ForcedOff)}} \quad \text{(Eq. 2)}$$

Figure 4:
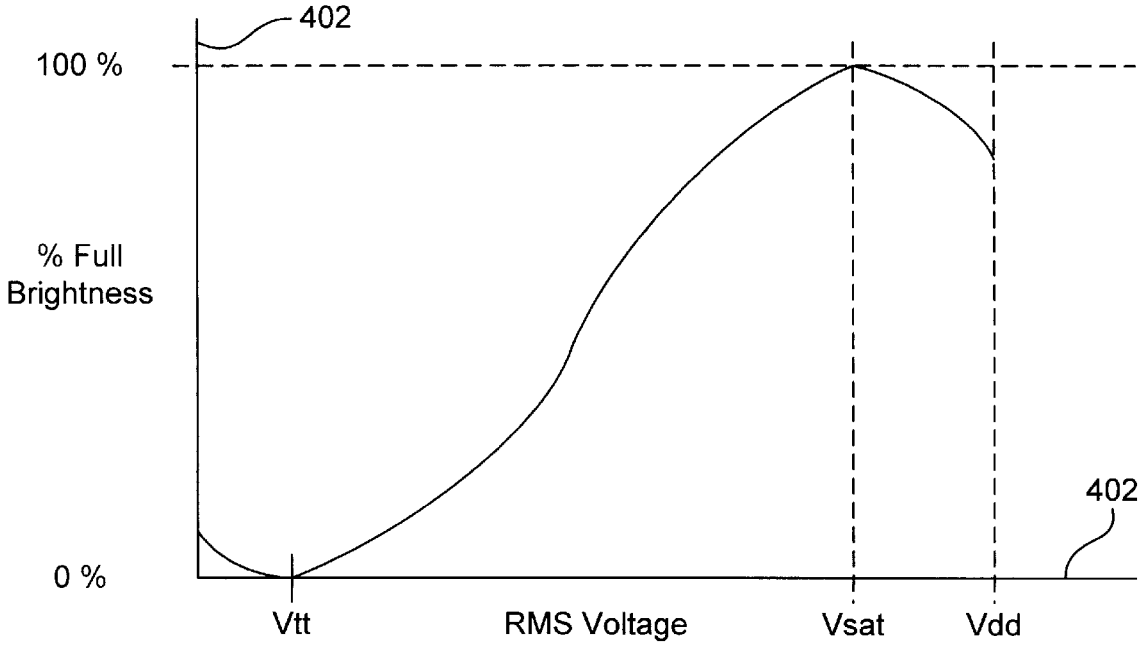
FIG. 4 Prior Art
FIG. 4 shows a brightness versus RMS voltage curve for a typical liquid crystal cell.
Figure 5:
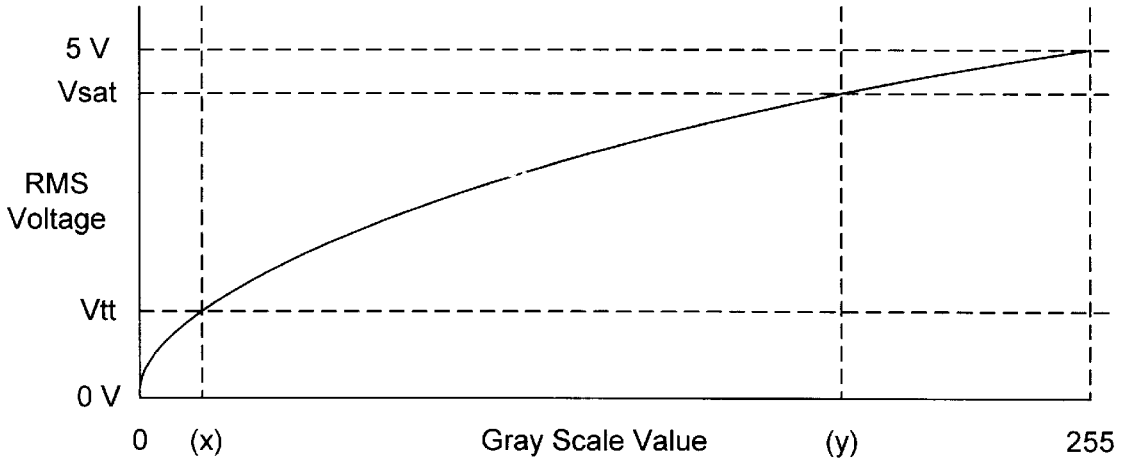
FIG. 5 Prior Art
FIG. 5 shows a gray scale value versus RMS voltage curve.

The added "on" states create a minimum RMS voltage floor 702, and the added "off" states create a maximum RMS voltage ceiling 704. RMS voltage floor 702 is raised and lowered by increasing or decreasing the number of additional "on" states, respectively. Similarly, RMS voltage ceiling 704 is lowered or raised by increasing or decreasing the number of additional "off" states, respectively. The number of added "on" and "off" states is selected such that RMS voltage floor 702 is equal to Vtt, the RMS voltage corresponding to 0% brightness (FIG. 4), and RMS voltage ceiling 704 is equal to Vsat, the RMS voltage corresponding to 100% brightness.

The optimum number of extra "on" and "off" states may be determined mathematically, using the following variables:

n=the number of bits of gray scale resolution;

G=the gray scale value;

Von=the digital "on" voltage;

Voff=the digital "off" voltage;

Vtt=the liquid crystal minimum brightness RMS voltage;

Vsat=the liquid crystal saturation RMS voltage;

Fon=the optimum number of fixed "on" states; and

Foff=the optimum number of fixed "off" states.

In general, the modified RMS voltage ("Vrms") is given by:

$$Vrms = \sqrt{\frac{(G + Fon)(Von)^2}{(2^n - 1) + Fon + Foff}} \quad \text{(Eq. 3)}$$

It is desirous that Vrms=Vtt, at G=0. Substituting theses values into Eq. 3 yields:

$$Vtt = \sqrt{\frac{Fon(Von)^2}{(2^n - 1) + Fon + Foff}} \quad \text{(Eq. 4)}$$

Similarly, it is desirous that Vrms=Vsat, at $G=2^n-1$. Substituting these values into Eq. 3 yields:

$$Vsat = \sqrt{\frac{[Fon + (2^n - 1)](Von)^2}{(2^n - 1) + Fon + Foff}} \quad \text{(Eq. 5)}$$

Solving Eq. 4 for Foff yields:

$$Foff = \frac{Fon(Von)^2}{(Vtt)^2} - Fon - (2^n - 1) \quad \text{(Eq. 6)}$$

Substituting Eq. 6 into Eq. 5, and solving for Fon yields:

$$Fon = \frac{(2^n - 1)(Vtt)^2}{(Vsat)^2 - (Vtt)^2} \quad \text{(Eq. 7)}$$

Substituting Eq. 7 into Eq. 6, and solving for Foff yields:

$$Foff = (2^n - 1)\left[\frac{((Von)^2 - (Vtt)^2)}{((Vsat)^2 - (Vtt)^2)} - 1\right] \quad \text{(Eq. 8)}$$

Finally, for given values of n, Vtt, Vsat, and Von, the optimum numbers of added "on" and "off" states are calculated from Eq. 7 and Eq. 8, respectively.

As indicated above, the required numbers of forced "on" and forced "off" states can be determined empirically, by iterating Fon and Foff until a gray value of 0 results in an RMS value near Vtt, and a gray value of $2^n-1$ results in an RMS value near Vsat. In one particular system, where n=8, Vtt=1.5V, Vsat=3.0V, and Vdd=3.3V, the iterating process yielded the following results:

| | |
|---|---|
| normal PWM states: | 255 |
| fixed "on" states: | 86 |
| fixed "off" states: | 82 |
| total states: | 423 |
| % increase in states | 66% |

Note that this number may differ from the calculated optimum number of forced states, and still provide an adequately modified LCD data stream.

Clearly, the overhead for the addition of extra states (66%) is significantly less that the overhead required to adding a single bit to the gray scale code (100%), and extremely less than adding two additional bits (200%). Furthermore, because the voltages of the forced "on" and "off" states are known, the forced states can be written to the pixel storage electrode apart from receiving the LCD gray scale data stream, thus reducing the bandwidth requirements for the system interface.

Figure 1:
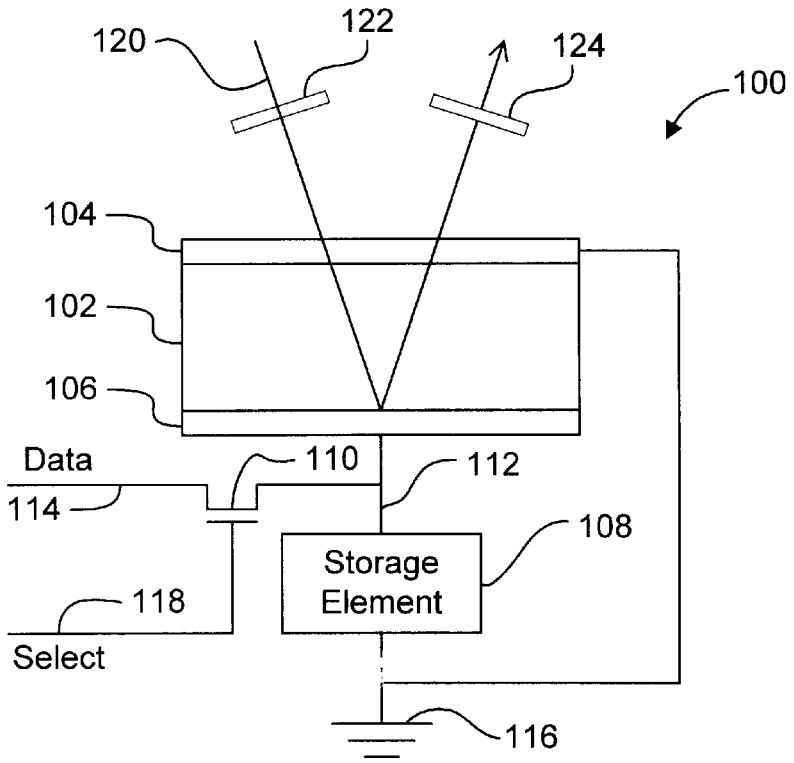
FIG. 1 Prior Art
FIG. 1 shows a single pixel cell of a typical liquid crystal display.
Figure 2:
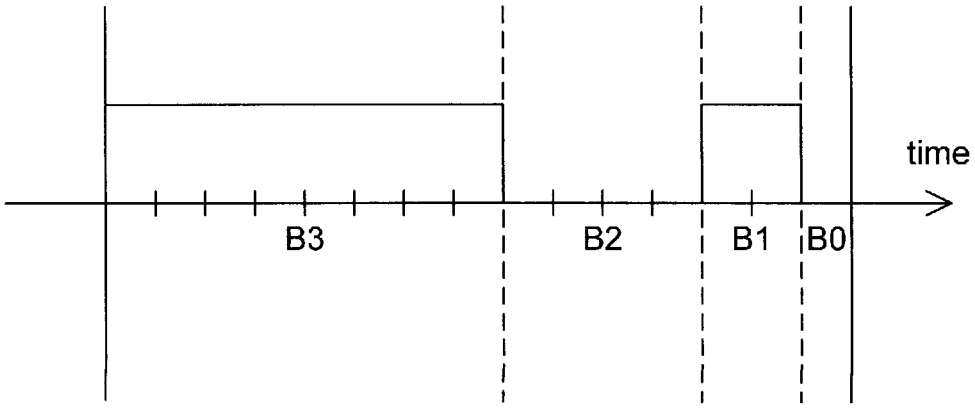
FIG. 2 Prior Art
FIG. 2 shows one frame of 4-bit pulse-width modulation data.
Figure 8:
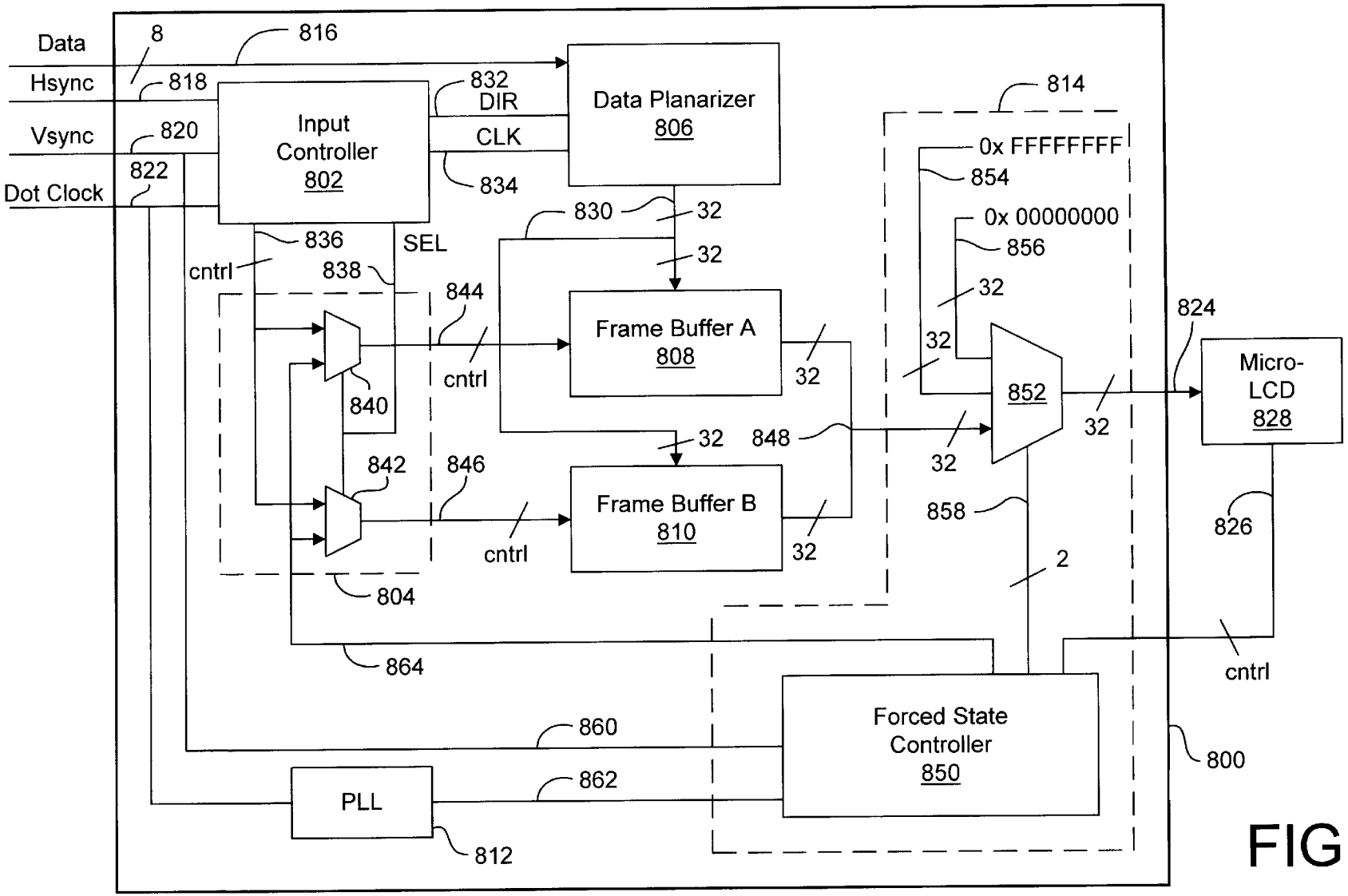
FIG. 8 shows a display driver in accordance with the present invention.

FIG. 8 shows an LCD driver 800 in accordance with the present invention. Driver 800 includes input controller 802, control selector 804, data planarizer 806, frame buffer A 808, frame buffer B 810, phase locked loop 812, and forced state generator 814. Driver 800 receives an 8-bit gray scale display data stream via data input bus 816, and receives horizontal synchronization (Hsync), vertical synchronization (Vsync), and pixel dot clock signals via input terminals 818, 820, and 822, respectively. After inserting forced states into the display data stream to improve gray scale performance, driver 800 transfers the modified display data, via 32-bit data output bus 824, along with control signals, via LCD control bus 826, to a micro-LCD 828, which includes an array of liquid crystal pixel cells, similar to the pixel cell shown in FIG. 1.

Input controller 802 uses the Hsync and Vsync signals to coordinate the transfer of data from data input bus 816 into data planarizer 806 and the transfer of data from data planarizer 806, via 32-bit data bus 830 into frame buffers A 808 and B 810. Responsive to the Vsync and Hsync signals indicating valid data on data input bus 816, input controller 802 asserts signals on control lines DIR 832 and CLK 834, causing data to be clocked into and out of data planarizer 806, as will be more fully described in conjunction with FIG. 10 below.

Data planarizer 806 receives the gray scale data, via data input bus 816, in 8-bit data words, each 8-bits (Pm[0–7]) corresponding to a gray scale value to be written to a particular pixel (m) of micro-LCD 828. Data planarizer 806 accumulates the 8-bit gray scale data for 32 pixels and reformats the data into 32-bit data words, each 32-bit word containing one bit from each of the group of 32 8-bit gray scale data words. For example, the 32-bit word formed by bits P0[0]–P31 [0] includes the least significant bits of the gray scale values of pixels 0–31. This reformatting is necessary because each bit of gray scale data is written to micro-LCD 828 32 pixels at a time. The reformatting of data by data planarizer 806 is discussed in greater detail in conjunction with FIG. 9 below.

Frame buffer A 808 and frame buffer B 810 are each 32-bit wide synchronous graphics random access memories (SGRAMs). Each of frame buffers 808 and 810 receives data, via 32-bit data bus 830, and stores the data in a memory location associated with a particular bit significance and a particular group of pixels of micro-LCD 828. Further, each of frame buffers 808 and 810 are of sufficient capacity to store 8 bits of gray scale data for each pixel in micro-LCD 828 (i.e., one frame worth of display data). For example, because micro-LCD 828 has 786,432 pixels (1024×768), frame buffers 808 and 810 each store 6,291,456 bits (one display screen worth) of data, or 196,608 32-bit words.

The transfer of data from data bus 830 into frame buffers 808 and 810 is also controlled by input controller 802 in cooperation with control selector 804. Input controller 802 asserts frame buffer control signals on input control bus 836 and a frame buffer select signal on select (SEL) line 838. Input control bus 836 includes a write enable line and address lines for indicating the memory location into which data is to be written.

Control selector 804 includes a first multiplexer 840 and a second multiplexer 842. First multiplexer 840 has two sets of input terminals, the first set being coupled to the lines of input control bus 836. Second multiplexer 842 also has two sets of input terminals, the second set being coupled to the lines of input control bus 836. The output of first multiplexer 840 is asserted on frame buffer A control bus 844, and the output of second multiplexer 842 is asserted on frame buffer B control bus 846.

First multiplexer 840 and second multiplexer 842 are both controlled by the SEL signal being asserted on select line 838 by input controller 802. Responsive to a first (e.g. high) SEL signal being asserted on select line 838, first multiplexer 840 couples input control bus 836 with frame buffer A control bus 844, thus allowing input controller 802 to load data from data bus 830 into frame buffer A 808. The first SEL signal also causes second multiplexer 842 to decouple input control bus 836 from frame buffer B control bus 846, so that no data is loaded into frame buffer B 810 while frame buffer A is being loaded. Responsive to a second (e.g., low) SEL signal being asserted on select line 838, first multiplexer decouples input control bus 836 from frame buffer A control bus 844 and couples input control bus 836 with frame buffer B control bus 846, thus allowing input controller 802 to load data from data bus 830 into frame buffer B 810. Input controller 802 toggles the SEL signal each time a Vsync signal is received, such that one display screen worth of data is written into each frame buffer 808 and 810 in alternating order.

Forced state generator 814 controls the output of data from frame buffer A 808 and frame buffer B 810, receives the display data via data bus 848, selectively inserts forced states into the display data stream, and outputs the modified display data stream via data output bus 824 to micro-LCD 828. Forced state generator 814 includes a forced state controller 850 and a multiplexer 852.

Multiplexer 852 receives data from data bus 848, from 32-bit "force-on" bus 854, and from 32-bit "force-off" bus 856. Each line of force-on bus 854 is maintained at a voltage (Von) corresponding to an "on" state, and each line of force-off bus 856 is maintained at a voltage (Voff) corresponding to an "off" state. In one embodiment, the sources of the forced state data asserted on force-on bus 854 and force-off bus 856 are system voltage reference terminals (e.g., Vdd and Ground). Those skilled in the art will understand, however, that alternate sources of forced state data, for example registers, may be employed. Responsive to control signals received via 2-bit control bus 858, multiplexer 852 selectively couples either data bus 848, force-on bus 854, or force-off bus 856 to data output bus 824. As used herein, the term "multiplexer" is understood to include all selective coupling devices, including, but not limited to, shared bus structures.

Forced state controller 850 receives the Vsync signal via line 860, and receives a clock input signal via line 862 from phase-locked loop 812. Phase-locked loop 812 is well known in the art, and serves to synchronize the pixel dot clock with an internal machine clock (not shown).

Forced state controller 850 controls the output of data from frame buffer A 808 and frame buffer B 810 by asserting control signals on an output control bus 864, which is coupled to the second set of input terminals of first multiplexer 840 and to the first set of input terminals of second multiplexer 842. Thus, when the second SEL signal is asserted on select line 838 by input controller 802, first multiplexer 840 decouples input control bus 836 from and couples output control bus 864 to frame buffer A control bus 844, thus allowing forced state controller 850 to cause frame buffer A 808 to assert data onto data bus 848. On the other hand, when the first SEL signal is asserted on select line 838, second multiplexer 842 decouples input control bus 836 from and couples output control bus 864 to frame buffer B control bus 846, allowing forced state controller 850 to cause frame buffer B 810 to assert data onto data bus 848. Thus, while pixel data for one frame is being loaded into frame buffer A 808 by input controller 802, pixel data for the previous frame is being outputted from frame buffer B 810 by forced state controller 850, and vice versa.

Forced state generator 814 inserts forced states (as shown in FIG. 6) into the display data stream as follows. First, a Vsync signal on line 860 indicates the start of a frame. Forced state controller 850 asserts a first control signal on 2-bit control bus 858, causing multiplexer 852 to couple force-on bus 854 to data output bus 824, thus asserting forced "on" states on data output bus 824. Then, forced state controller 850 asserts control signals on LCD control bus 826 causing forced on states to be loaded from data output bus 824 into micro-LCD 828. After the desired number of forced on states are loaded into micro-LCD 828, forced state controller 850 asserts a second control signal on 2-bit control bus 858, causing multiplexer 852 to couple data bus 848 to data output bus 824. Then, forced state controller 850 asserts frame buffer control signals on output control bus 864 and LCD control signals on LCD control bus 826, causing data to be transferred out of either frame buffer A 808 or frame buffer B 810 (depending on the current SEL signal), through multiplexer 852, and into micro-LCD 828. Data continues to be transferred from frame buffer A 808 or B 810 until an entire frame of display data has been transferred. Then, forced state controller 850 asserts a third control signal on 2-bit data bus 858, causing multiplexer 852 to couple force-off bus 856 to data output bus 824, and asserts LCD control signals on LCD control bus 826 causing the desired number of forced off states to be transferred into micro-LCD 828, thus completing the first half 608 of frame 610 (FIG. 6).

The second half 612 of frame 610 (FIG. 6) is written to micro-LCD 828 substantially as described above, except that the forced on states, the data, the forced off states, and the common electrode are inverted. The inversion occurs within micro-LCD 828 under the control of forced state controller 850 as follows. LCD control bus 826 includes address lines, op code lines for communicating instructions (e.g., read, write, etc.), a data invert line, a common electrode signal line, and a clock signal line. At the beginning of the second half 612 of frame 610, forced state controller 850 switches the signal being asserted on the common electrode signal line from low to high, and asserts a control signal on the invert line causing micro-LCD 828 to invert all incoming data. The data and the forced states are then transferred out of driver 800 under the control of forced state controller 850 as described above.

Figure 8B:
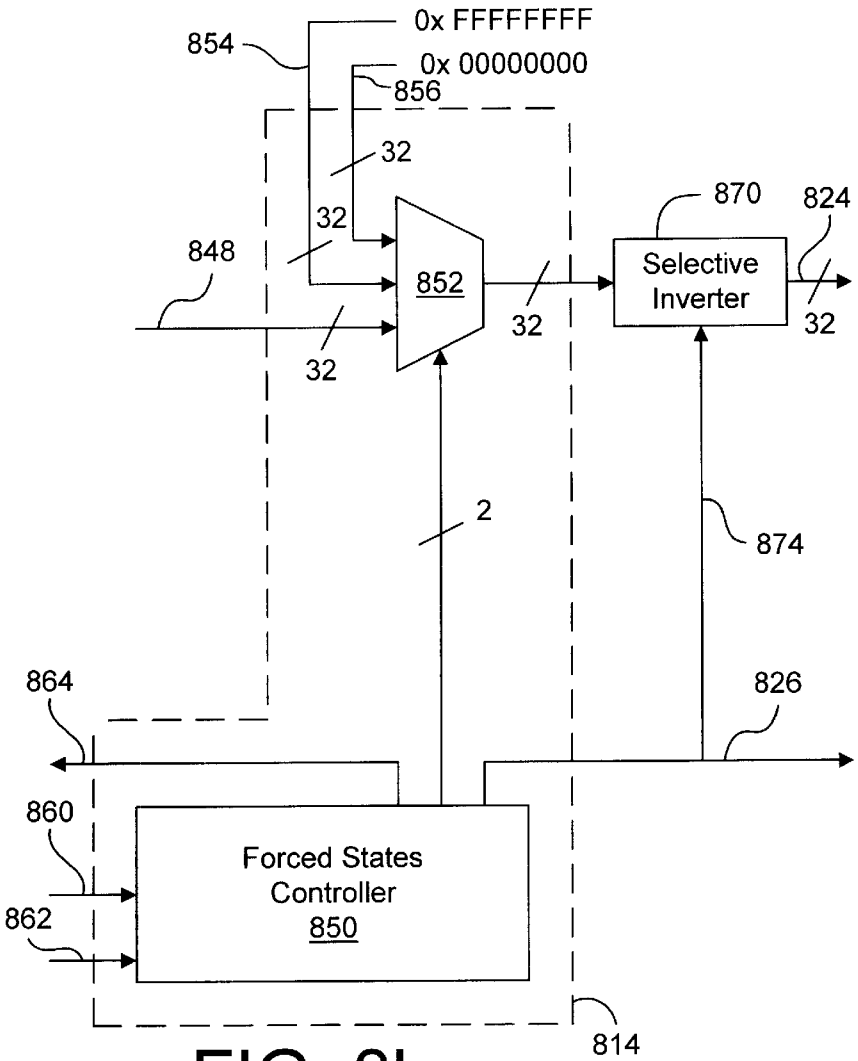
Figure 8A:
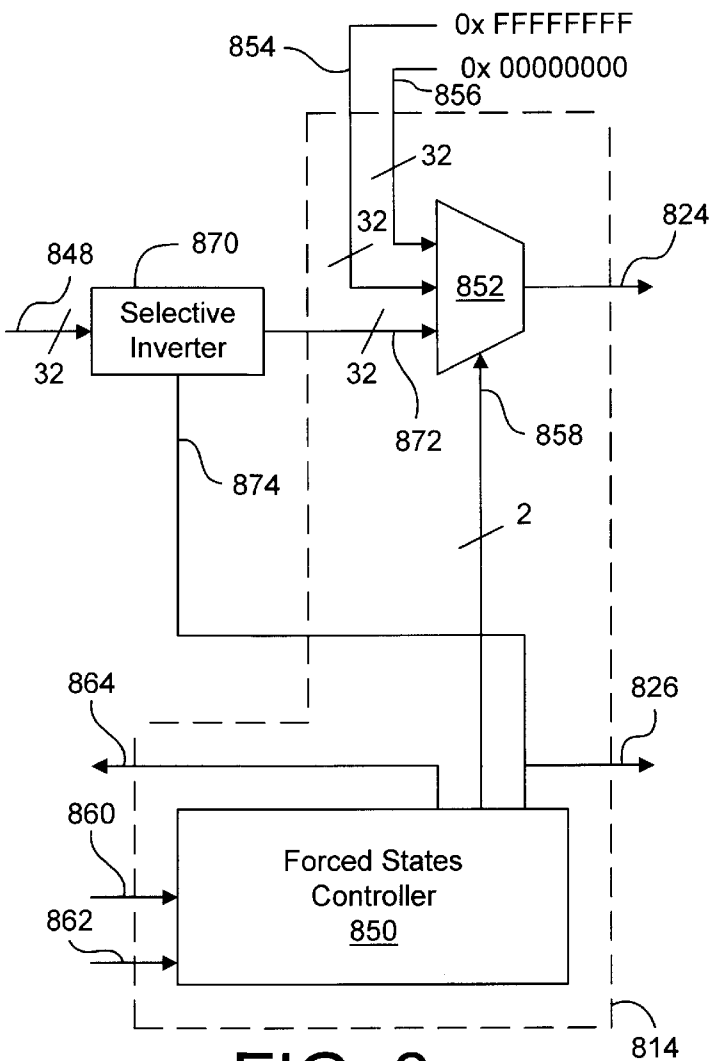

Alternatively, the inversion of the forced on states, the data, and the forced off states may be implemented within driver 800. For example, FIG. 8*a* shows an alternate embodiment of controller 800, including a selective inverter 870 interposed between data bus 848 and data input terminals 872 of multiplexer 852, to selectively invert the data stream. The invert line 874 is redirected from LCD control bus 826 to selective inverter 870. Responsive to a first signal on invert line 874, selective inverter 870 asserts the data received via data bus 848 onto data input terminals 872 of multiplexer 852. Responsive to an invert signal on invert line 874, selective inverter 870 inverts the data received via data bus 848, and asserts the inverted data onto data input terminals 872 of multiplexer 852. In this embodiment, forced state controller 850 controls the inversion of the forced on and forced off states, by controlling multiplexer 852 as described above, but reversing temporally, the couplings of bus 854 and bus 856 to bus 824. FIG. 8*b* shows another alternate embodiment of driver 800, wherein selective inverter 870 is coupled to receive and selectively invert the modified data stream, which includes the forced states.

Figure 9:
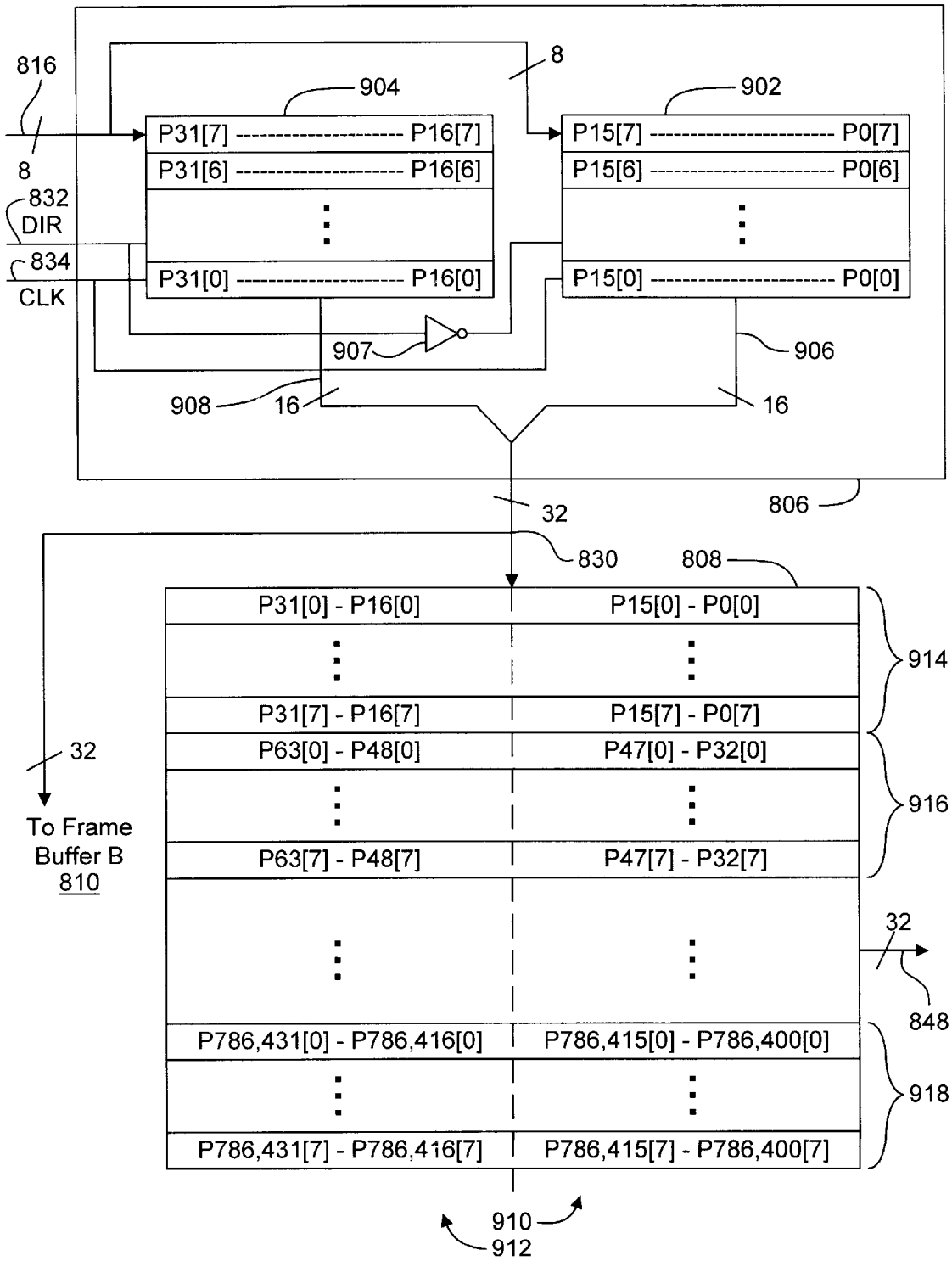
FIG. 9 illustrates a data path through a data planarizer and a frame buffer in accordance with the present invention.

FIG. 9 shows an example of data flow through data planarizer 806 and into frame buffer A 808. Data planarizer 806 includes a first bi-directional shift register 902 and a second bi-directional shift register 904, each serving as a temporary storage bank. Each register 902 and 904 is 16 bits deep (16 columns) and 8 bits wide (8 rows). The bit depth corresponds to the number of incoming data words each register has the capacity to store, and the bit-width corresponds to the number of bits in each incoming data word, which in this particular embodiment is the number of bits per pixel.

Data enters shift registers 902 and 904 via 8-bit data input bus 816, as previously described, and is organized within registers 902 and 904 as follows. First, the 8 bits of gray scale data for pixel 0 (P0[0–7]) enter, via data input bus 816, and are stored in the right most column of register 902. The next 8-bits P1[0–7] enter and are stored in the column to the left of bits P0[0–7]. The data continues to be loaded in this fashion until the bits P15[0–7] are loaded in the left most column of register 902. The 8-bit gray scale data for pixels P16–P31 is then loaded into register 904 in like fashion, such that bits P16[0–7] are loaded in the right most column and bits P31[0–7] are loaded in the left most column.

Thus loaded, each row of register 902 and register 904 contains a 16-bit word, including one bit of similar significance from 16 sequential pixels. For example, the bottom row of register 904 includes the least significant bits from the gray scale data for pixels P16–P31. Furthermore, like numbered rows of registers 902 and 904 combine to form 32-bit words, each including one bit of similar significance from 32 sequential pixels. For example, the top rows of registers 902 and 904 include the most significant bits from the gray scale data for pixels P0–P31. These 32-bit words are written, via data bus 830, into frame buffers A 808 and B 810, to be stored for subsequent transfer to micro-LCD 828.

Frame buffers A 808 and B 810 are able to read one-half of data bus 830 at a time. Additionally, an inverter 907, having an input terminal coupled to direction control line 832, provides register 902 with an inverted direction control signal. This allows planarizer 806 to write the contents of register 902 to frame buffer A 808 or frame buffer B 810 while register 904 is being loaded. For example, as data is being clocked into register 904 via data input bus 816, data is being clocked out of register 902 via a first half 906 of data bus 830. Similarly, when data is being clocked into register 902 via data input bus 816, data is being clocked out of register 904 via a second half 908 of data bus 830.

Accordingly, a frame worth of data is formatted by data planarizer 806 and stored in either frame buffer A 808 or B 810 as follows. Each memory location in frame buffers A 808 and B 810 is divided into a first half 910 and a second half 912. The gray scale data for pixels P0–P15 is clocked into register 902, as described above. Then, as the next block of data for pixels P16–P31 is clocked into register 904, the data for pixels P0–P15 is clocked into first half 910 of a first memory block 914 (each block contains 8 32-bit memory locations). Next, as the data for pixels P32–P47 is clocked into register 902, the data for pixels P16–P31 is clocked into second half 912 of first memory block 914. Then, as the data for pixels P48–P63 is clocked into register 904, the data for pixels P32–P47 is clocked into first half 910 of a second memory block 916. This sequence continues until the data for the last pixels (P786,416–P786,431) is clocked from register 904 into second half 912 of a last memory block 918.

Those skilled in the art will recognize that additional bi-directional shift registers may be employed. For example, four registers, each 8-bits deep, could be used to write 8 bits to each of four different portions of each memory location, thus writing a 32-bit word to each memory location.

Figure 10:
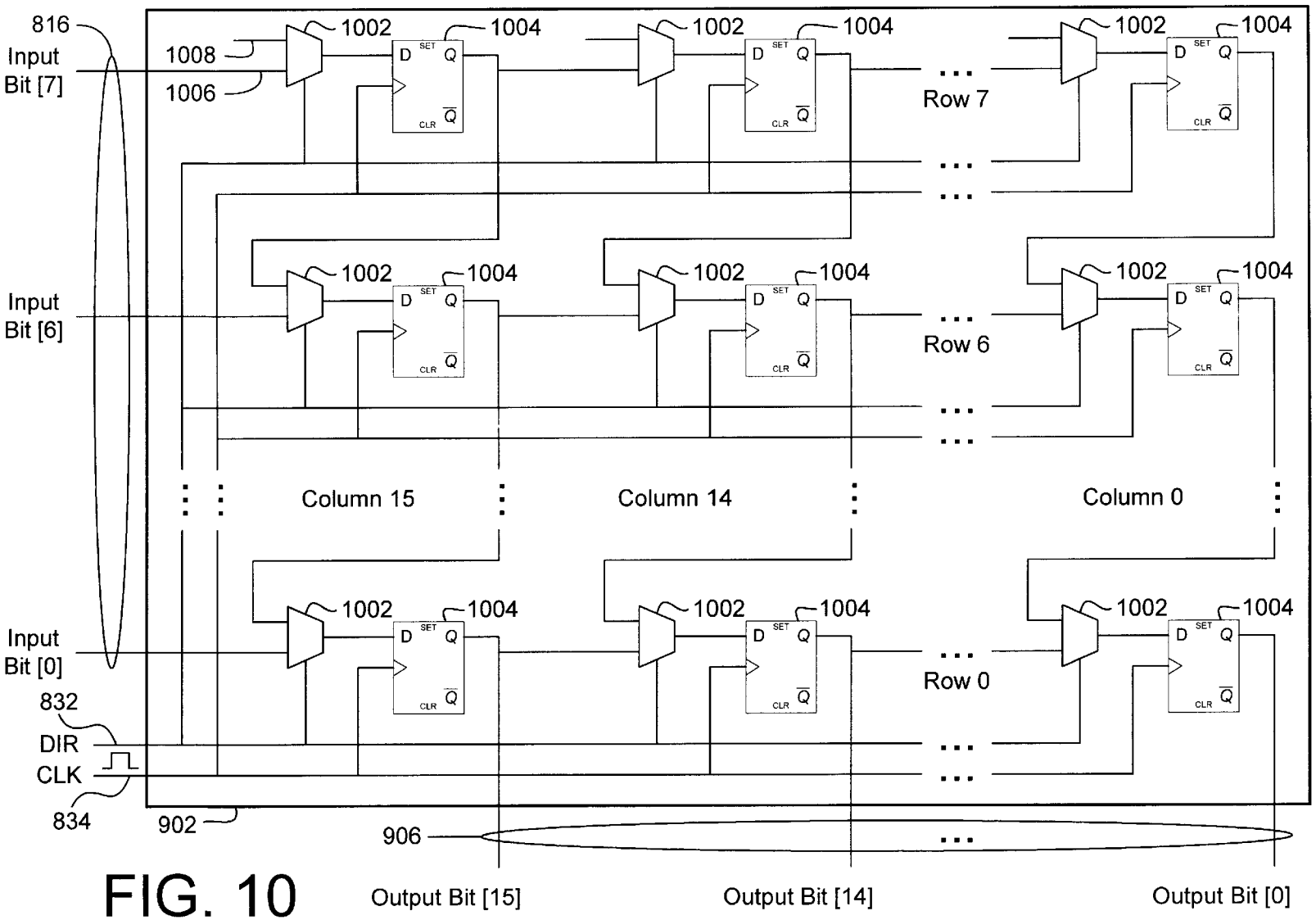
FIG. 10 shows a bi-directional shift register of the data planarizer shown in FIG. 9.

FIG. 10 shows first bi-directional shift register 902 in greater detail. Second bi-directional shift register 904 is substantially identical. Register 902 includes 128 D-type flip-flops 1002 arranged in a rectangular array of 16 columns (0–15) and 8 rows (0–7), and an associated array of multiplexers 1004 also arranged in a rectangular array of 16 columns and 8 rows. To facilitate clear explanation, the notation (r,c) refers to the row and column location of a given device. For example, multiplexer 1004(6,14) refers to the multiplexer 1004 located in row 6 and column 14. The rows and columns are labeled in FIG. 10 to correspond to the bit numbers of data input bus 816 and first half 906 of data bus 830, respectively.

All flip-flops 1002(r,c) receive a clock signal from input controller 802 (FIG. 8) via CLK line 834, and all the multiplexers 1004(r,c) receive control input from input controller 802 via DIR line 832. The input (D) of each flip-flop 1002(r,c) is coupled to the output of an associated multiplexer 1004(r,c) located in the same row and column.

Each multiplexer 1004(r,c) has a first input terminal 1006 and a second input terminal 1008, which are selectively coupled to the input (D) of associated flip-flop 1002(r,c), depending on the control signal being asserted on DIR line 832. First input terminals 1006 of multiplexers 1004(r, 15) (column 15) are coupled to associated bit lines of data input bus 816. In the remaining columns (c<15), first input terminals 1006 of multiplexers 1004(r,c) are coupled to the non-inverting output (Q) of associated flip-flops 1002(r,c+1) (left neighbors). Second input terminals 1008 of multiplexers 1004(7,c) (row 7) are not used. In the remaining rows (r<7), second input terminals 1008 of multiplexers 1004(r,c) are coupled to the non-inverting output (Q) of associated flip-flops 1002(r+1,c) (upper neighbors). Finally, the non-inverting (Q) output of flip-flops 1002(0,c) (row 0) are coupled to corresponding bit lines of first half 906 of data bus 830.

Bi-directional shift register 902 operates as follows. When input controller 802 asserts a first signal on DIR control line 832, all multiplexers 1004(r,c) couple their first input terminals 1006 with the inputs (D) of flip-flops 1002 (r,c). Then, when the first clock signal is received via CLK line 834, flip-flops 1002(r,15) latch the 8-bit data word present on data input bus 816 onto their non-inverting (Q) outputs. When the next clock signal is received, the first 8-bit word stored by flip-flops 1002(r, 15) is shifted to the non-inverting outputs (Q) of flip-flops 1002(r, 14), and flip-flops 1002(r, 15) latch the next 8-bit data word present on data input bus 816 onto their non-inverting (Q) outputs. Upon receiving each subsequent clock signal, new data is received and the previously received data is shifted to the right. This continues until register 902 has loaded 16 8-bit words (one on each column of flip-flops).

Input controller 802 shifts data out of register 902 by asserting a second signal on DIR line 832. Responsive to the second signal on DIR line 832, each multiplexer couples its second input terminal with its output terminal, thus changing the shift direction. Until the next clock signal is received, flip-flops 1002(0,c) are asserting bit 0 of each of the 16 stored 8-bit words on bit lines 0–15 of bus 906. When the next clock signal is received, the bit stored on the non-inverting outputs (Q) of each flip-flop 1002(r,c) is latched onto the non-inverting output of flip-flop 1002(r−1,c) (lower neighbor), thus asserting bit 1 of each of the 16 stored 8-bit words on bit lines 0–15 of bus 906. This process continues as each clock signal is received until all 8 bits (0–7) of each of the 16 stored words have been sequentially asserted on bus 906. After register 904 is loaded (it takes longer to load than to unload registers 902 and 904, i.e., 16 cycles versus 8 cycles), input controller 802 reasserts the first signal on DIR line 832 so that register 902 can be reloaded.

Figure 11:
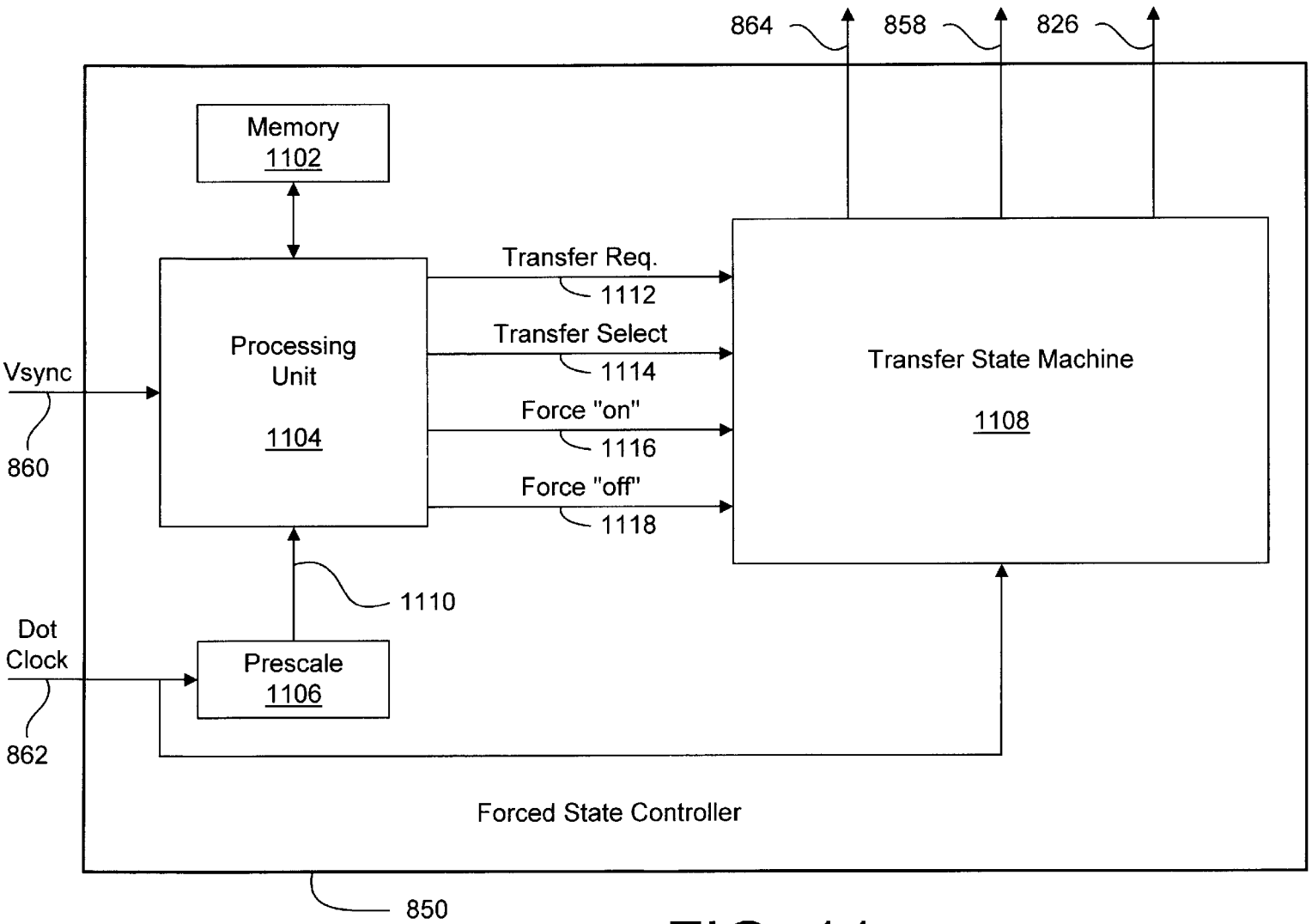
FIG. 11 shows a forced state controller of the driver shown in FIG. 8.

FIG. 11 shows forced state controller 850, in greater detail, to include a memory 1102, a processing unit 1104, a prescale 1106, and a transfer state machine 1108. Memory 1102 is a program storage device, which stores data and commands for access and execution by processing unit 1104. Prescale 1106 receives the dot clock signal via line 862, generates a lower frequency timing signal (e.g., ½ the frequency of the dot clock), and communicates the timing signal, via line 1110 to processing unit 1104. The lower frequency timing signal enables processing unit 1104 to employ smaller scale components, for example, smaller counters.

Processing unit 1104 controls transfer state machine 1108 via a transfer request line 1112, transfer select bus 1114, force-on line 1116, and force-off line 1118. Responsive to the signals received from processing unit 1104, transfer state machine 1108 asserts control signals on LCD control bus 826 (FIG. 8), 2-bit control bus 858, and output control bus 864, as follows.

Responsive to a signal on transfer request line 1112, transfer state machine 1108 asserts a control signal on 2-bit control bus 858 causing multiplexer 852 to couple data output bus 824, via data bus 848, to frame buffers A 808 and B 810. Transfer select line 1114 is a multi-bit line used to communicate the address of the memory block to be transferred out of frame buffer A 808 or frame buffer B 810. Transfer state machine 1108 uses the block address to initialize the memory address asserted on output control bus 864, and then sequentially increments the memory address while asserting a write signal on LCD control bus 826.

Responsive to processing unit 1104 asserting a signal on force-on line 1116, transfer state machine 1108 asserts a signal on 2-bit control bus 858, causing multiplexer 852 to couple force-on bus 854 with data output bus 824. Then, transfer state machine 1108 asserts a write signal on LCD control bus 826, thus transferring forced on states into micro-LCD 828. Similarly, responsive to processing unit 1104 asserting a signal on force-off line 1118, transfer state machine 1108 asserts a signal on 2-bit control bus 858, causing data selector 852 to couple force-off bus 856 with data output bus 824, and asserts a write signal on LCD control bus 826, to transfer forced off states into micro-LCD 828.

In one embodiment, forced state controller 850 is implemented with a programmable logic device part number EPF10K50 BC356-3, manufactured by Altera Corporation of Santa Clara, Calif. The verilog code for programming this device is attached hereto as a microfiche appendix.

Figure 12:
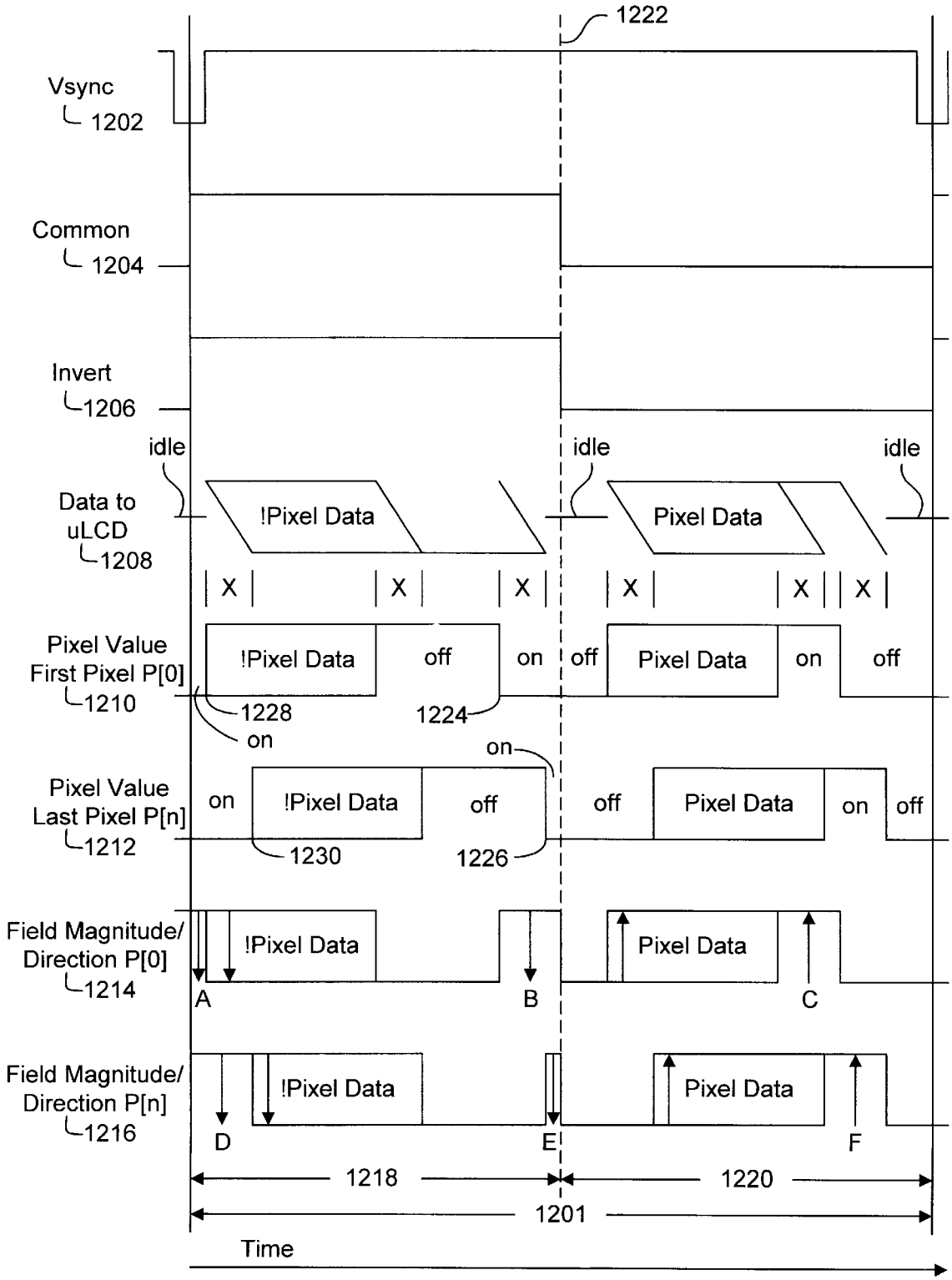
FIG. 12 shows a timing diagram for data and certain control signals communicated between the driver and the micro-LCD shown in FIG. 8.

FIG. 12 shows a timing diagram 1200 detailing the relationship, during one frame time 1201, between the Vsync signal 1202, the common micro-LCD electrode signal 1204, the data invert signal 1206, the pixel data 1208, the first pixel value 1210, the last pixel value 1212, the magnitude and direction of the voltage drop across the first pixel 1214, and the magnitude and direction of the voltage drop across the last pixel 1216. Timing diagram 1200 is useful to illustrate practical considerations which must be taken into account when implementing driver 800.

Figure 3:
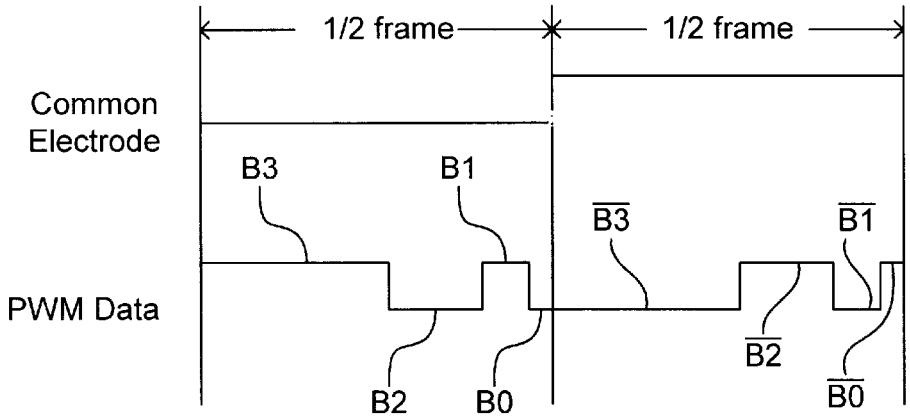
FIG. 3 Prior Art
FIG. 3 shows a split frame of 4-bit pulse-width modulation data.

Recall from the discussion of FIG. 3 that the net dc voltage over time across each liquid crystal cell must be zero, in order to avoid damage to the cell caused by ionic migration. Therefore, the common signal 1204 and the pixel data 1208 are inverted during a first half 1218 of frame 1201 and are not inverted during a second half 1220 of frame 1201. It does not matter whether the common signal 1204 and the data 1206 are inverted during the first 1218 or second 1220 half of frame 1201, as long as the net dc voltage across each cell is zero.

Practical limitations arise because, while the single common electrode signal may be switched very rapidly at the mid point 1222 of frame 1201, it takes some finite amount of time (X) to write the first bit of LCD data to each of the pixels in micro-LCD display 828, as shown by the angled edges of micro-LCD data curve 1208. It is, therefore, desirable to switch the common electrode signal at a time when a forced on or a forced off state is being asserted on every pixel. This results in a very rapid, simultaneous switch of the signals on all of the pixels. Specifically, all forced on states become forced off states, and all forced off states become forced on states, as soon as the common electrode is switched.

The time (X) that it takes to write data to all the pixels also effects the writing of forced states. Comparing first pixel value curve 1210 to last pixel value curve 1212, it is apparent that there is a time delay (X) between writing the first forced on state to the first pixel at 1224 and writing the first forced on state to the last pixel at 1226. In general, this delay is offset, because of the time delay (X) between writing data to the first pixel at 1228 and writing data to the last pixel at 1230. There must be, however, an adequate number of forced states to accommodate the offset. In particular, it is sufficient if the minimum forced-on time and the minimum forced-off time equals 2X, where X is the time required to write to each pixel once, as described above.

Certain timing relationships are also necessary to maintain equal brightness across the display and to maintain a debiased (net dc voltage=0) condition. The following timing relationships are sufficient, and refer to the voltage drops labeled in voltage drop magnitude/direction curves 1214 and 1216. First, in order to debias the first pixel, voltage drops A and B must be equal in magnitude and opposite in direction to voltage drop C, while the sum of the time intervals that voltage drops A and B are applied must equal the time interval voltage drop C is applied. Similarly, voltage drops D and E must be equal in magnitude and opposite in direction to voltage drop F, while the sum of the time intervals that voltage drops D and E are applied must equal the time interval voltage drop F is applied. The pixel data (Pixel Data) is, by definition, equal in magnitude and opposite in direction to the complementary pixel data (!Pixel Data). Next, in order to maintain equal brightness (RMS voltage offset), the sum of voltage drops A and B must be equal in magnitude and direction to the sum of voltage drops D and E, and voltage drop C must be equal in magnitude and direction to voltage drop F. Finally, the first half 1218 of frame 1201 should be equal in time duration to the second half 1220 of frame 1201. Those skilled in the art will understand, that the sequence of data and forced states, the division of the frame, and the switching of the common electrode may be altered without deviating from the scope of the invention, however the fundamental debias and RMS voltage offset conditions must be maintained. The above described timing diagram 1200 illustrates only one of many possible ways of accomplishing this.

The description of particular embodiments of the present invention is now complete. Many of the described features may be substituted, altered or omitted without departing from the scope of the invention. For example, the invention may be employed to align data with the response curves of transmissive LCD displays and of displays other than LCD displays. Additionally, the invention may be used in a multi-color system by using a separate driver and display for each color, or by time multiplexing a single driver and display for more than one color. Additionally, the invention may employed with analog displays and may incorporate forced states having voltages other than digital "on" or digital "off." Additionally, the invention may employed with a wide variety of pulse modulation schemes including, but not limited to, pulse-amplitude modulation, pulse-width modulation, pulse-position modulation, and pulse-code modulation. Further, data planarizer 806 may include additional, smaller bi-directional shift registers to enable data reformatting in even smaller increments.

We claim:

1. A display driver circuit for receiving a display data stream and providing a modified display data stream, said display driver circuit comprising a state generator for receiving said display data stream, and modifying said received display data stream by adding at least one forced state to generate said modified display data stream, and wherein an optimum number of said forced states depends on a bit resolution of said display data, a liquid crystal minimum brightness RMS voltage, and a liquid crystal saturation RMS voltage.

2. A display driver circuit according to claim 1, wherein said state generator comprises:

a multiplexer having a data input terminal coupled to receive said display data stream, a first forced state input terminal for receiving first forced state data, a data output terminal for providing said modified data stream, and a first control input terminal; and a controller having a first control output terminal coupled to said first control input terminal of said multiplexer for causing said multiplexer to selectively couple said data input terminal and said first forced state input terminal to said data output terminal to provide said modified display data stream.

3. A display driver circuit according to claim 2, further comprising a source of said first forced state data coupled to said first forced state input terminal.

4. A display driver circuit according to claim 2, wherein said first forced state input terminal is coupled to a system voltage reference terminal.

5. A display driver circuit according to claim 2, wherein:

said multiplexer further includes a second forced state input terminal for receiving second forced state data, and a second control input terminal; and wherein said controller further includes a second control output terminal coupled to said second control input terminal of said multiplexer, whereby, in response to a control signal asserted on said first and second control input terminals of said multiplexer, said multiplexer selectively couples one of said first forced state input terminal, said second forced state input terminal, and said data input terminal with said data output terminal of said multiplexer.

6. A display driver circuit in according to claim 5, further comprising a source of said second forced state data coupled to said second forced state input terminal.

7. A display driver circuit according to claim 6 wherein said second forced state data input terminal is coupled to a system voltage reference terminal.

8. A display driver circuit according to claim 2, further comprising a data storage device having a data output terminal coupled to said data input terminal of said multiplexer, for storing said display data and asserting said display data on said data input terminal of said multiplexer.

9. A display driver circuit according to claim 8, wherein:

said data storage device includes a transfer control input terminal; and said controller includes a transfer control output terminal coupled to said transfer control input terminal of said data storage device, for communicating a data transfer signal causing said data storage device to assert said display data on said data input terminal.

10. A display driver circuit according to claim 8, further comprising an address bus coupled between said data storage device and said controller, for communicating a storage address of data to be asserted on said data input terminal of said multiplexer by said data storage device.

11. A display driver circuit according to claim 2, wherein said controller further comprises an invert terminal for outputting an invert control signal.

12. A display driver circuit according to claim 11, further comprising a selective inverter for selectively inverting said display data stream, said selective inverter having an input terminal coupled to receive said display data stream, an output terminal coupled to said data input terminal of said multiplexer, and a control terminal coupled to said invert terminal of said controller.

13. A display driver circuit according to claim 11, further comprising a selective inverter for selectively inverting said modified display data stream, said selective inverter having an input terminal coupled to said data output terminal of said multiplexer, a control terminal coupled to said invert terminal of said controller, and an output terminal for outputting said modified display data stream and said inverted modified display data stream.

14. A display driver circuit comprising:

receiving means for receiving a display data stream;

state generating means for adding at least one forced state to said display data stream to create a modified display data stream; and output means for outputting said modified display data stream; and wherein, an optimum number of said forced states depends on a bit resolution of said display data, a liquid crystal minimum brightness RMS voltage, and a liquid crystal saturation RMS voltage.

15. A display driver circuit according to claim 14, wherein said state generating means comprises first forced state generating means for adding at least one forced state of a first type to said display data stream.

16. A display driver circuit according to claim 15, wherein said state generating means further comprises second forced state generating means for adding at least one forced state of a second type to said display data stream.

17. A display driver circuit according to claim 16, wherein said output means comprises:

first forced state output means for outputting said at least one forced state of said first type;

display data output means for outputting said display data stream; and second forced state output means for outputting said at least one forced state of said second type.

18. A display driver circuit according to claim 17, further comprising invert signal means for outputting an invert signal.

19. A display driver according to claim 17, further comprising:

first complementary output means for outputting the complement of said at least one forced state of said first type;

complementary data output means for outputting the complement of said display data stream; and second complementary output means for outputting the complement of said at least one forced state of said second type.

20. A method for modifying a display data stream to achieve improved gray scale performance in a display, said method comprising the steps of:

receiving a display data stream;

adding at least one forced state of a first type to said display data stream to create a modified display data stream; and outputting said modified display data stream; and wherein, an optimum number of said forced states of said first type depends on a bit resolution of said display data, a liquid crystal minimum brightness RMS voltage, and a liquid crystal saturation RMS voltage.

21. A program storage device readable by a machine and encoding a program of instructions for executing the method of claim 20.

22. A method according to claim 20, wherein said step of adding at least one forced state of said first type to said display data stream further comprises adding a plurality of forced states of said first type.

23. A method according to claim 22, wherein said step of adding said plurality of forced states of said first type includes the step of adding said plurality of forced states of said first type contiguously.

24. A program storage device readable by a machine and encoding a program of instructions for executing the method of claim 22.

25. A method according to claim 20, wherein the step of adding said forced state of said first type comprises adding a digital "on" state.

26. A program storage device readable by a machine and encoding a program of instructions for executing the method of claim 25.

27. A method according to claim 20, wherein the step of adding said forced state of said first type comprises adding a digital "off" state.

28. A program storage device readable by a machine and encoding a program of instructions for executing the method of claim 27.

29. A method according to claim 20, further comprising the step of adding at least one forced state of a second type, and wherein an optimum number of said forced states of said second type depends on a bit resolution of said display data, a liquid crystal minimum brightness RMS voltage, a liquid crystal saturation RMS voltage, and a digital "on" voltage.

30. A program storage device readable by a machine and encoding a program of instructions for executing the method of claim 29.

31. A method according to claim 29, wherein said step of adding at least one forced state of said first type includes the step of adding a plurality of forced states of said first type.

32. A program storage device readable by a machine and encoding a program of instructions for executing the method of claim 31.

33. A method according to claim 29, wherein said step of adding at least one forced state of said second type includes the step of adding a plurality of forced states of said second type.

34. A program storage device readable by a machine and encoding a program of instructions for executing the method of claim 33.

35. A method according to claim 33, wherein said step of adding said plurality of forced states of said second type includes the step of adding said plurality of forced states of said second type contiguously.

36. A method according to claim 33 wherein:

said step of adding at least one forced state of said first type includes the step of adding a plurality of forced states of said first type; and said step of adding at least one forced state of said second type includes the step of adding a plurality of forced states of said second type.

37. A method according to claim 36, wherein:

said plurality of forced states of said first type comprises a plurality of digital "on" states; and said plurality of forced states of said second type comprises a plurality of digital "off" states.

38. A program storage device readable by a machine and encoding a program of instructions for executing the method of claim 36.

39. A method according to claim 29, wherein said step of outputting said modified display data stream comprises:

outputting said plurality of forced states of said first type;

outputting said display data stream; and outputting said plurality of forced states of said second type.

40. A method according to claim 39, wherein said step of outputting said plurality of forced states of said first type comprises outputting said plurality of forced states of said first type contiguously.

41. A program storage device readable by a machine and encoding a program of instructions for executing the method of claim 39.

42. A method according to claim 39, wherein said step of outputting said plurality of forced states of said second type comprises outputting said plurality of forced states of said second type contiguously.

43. A method according to claim 42, wherein said step of outputting said display data stream comprises outputting said display data stream contiguously.

44. A method according to claim 39, wherein said step of outputting said modified data stream further comprises:

outputting the complement of said plurality of forced states of said first type;

outputting the complement of said display data stream; and outputting the complement of said plurality of forced states of said second type.

45. A program storage device readable by a machine and encoding a program of instructions for executing the method of claim 44.

46. A method according to claim 39, wherein said step of outputting said modified data stream further comprises:

outputting an invert signal;

outputting said plurality of forced states of said first type a second time;

outputting said display data stream a second time; and outputting said plurality of forced states of said second type a second time.

47. A program storage device readable by a machine and encoding a program of instructions for executing the method of claim 46.

* * * * *

UNITED STATES PATENT AND TRADEMARK OFFICE

CERTIFICATE OF CORRECTION

PATENT NO. : 6,072,452

DATED : 6/6/2000

INVENTOR(S) : Worley, III, et al.

It is certified that error appears in the above-identified patent and that said Letters Patent is hereby corrected as shown below:

Column 5, line 30, the portion reading "Serial No. M-5011" should read --Serial No. 08/970,887--. Column 5, lines 33-34, the portion reading "Serial No. M-5016" should read --Serial No. 08/970,665--. Column 5, lines 36-37, the portion reading "Serial No. M-5246" should read --Serial No. 08/970,307--. Column 5, line 41, the portion reading "Serial No. M-5281" should read --Serial No. 08/970,443--. Column 5, line 44, the portion reading, "serial no. M-5019" should read --Serial No. 08/901,059--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*